US009714077B2

(12) United States Patent
Soileau et al.

(10) Patent No.: US 9,714,077 B2
(45) Date of Patent: Jul. 25, 2017

(54) ADJUSTABLE AND CINCHABLE FLOATING BULKHEAD SYSTEM FOR A KAYAK

(71) Applicants: Christopher James Soileau, Florence, AL (US); Trevor Valmont Soileau, Florence, AL (US)

(72) Inventors: Christopher James Soileau, Florence, AL (US); Trevor Valmont Soileau, Florence, AL (US)

( * ) Notice: Subject to any disclaimer, the term of this patent is extended or adjusted under 35 U.S.C. 154(b) by 0 days.

(21) Appl. No.: 15/161,157

(22) Filed: May 20, 2016

(65) Prior Publication Data

US 2016/0340010 A1 Nov. 24, 2016

Related U.S. Application Data

(60) Provisional application No. 62/165,898, filed on May 23, 2015.

(51) Int. Cl.

| | |
|---|---|
| ***B63B 17/00*** | (2006.01) |
| ***B63H 16/02*** | (2006.01) |
| ***B63H 16/04*** | (2006.01) |
| ***B63B 35/71*** | (2006.01) |

(52) U.S. Cl.
CPC ..... *B63H 16/02* (2013.01); *B63B 35/71* (2013.01); *B63B 2035/715* (2013.01)

(58) Field of Classification Search
CPC .... B63H 16/02; B63B 35/71; B63B 2035/715
USPC ..... 440/101; 114/363
See application file for complete search history.

(56) References Cited

U.S. PATENT DOCUMENTS

| | | | | |
|---|---|---|---|---|
| 304,474 | A * | 9/1884 | Turpel | B63B 29/04 114/363 |
| 4,744,327 | A * | 5/1988 | Masters | B63B 35/71 114/347 |
| 5,544,613 | A * | 8/1996 | Scarborough | B63H 16/02 114/347 |
| 5,975,006 | A * | 11/1999 | Lewit | B63H 16/02 114/347 |
| 9,517,814 | B2 * | 12/2016 | Robbins | B63B 17/00 |
| 2002/0005157 | A1 * | 1/2002 | Knight | B63B 17/00 114/347 |

* cited by examiner

*Primary Examiner* — Anthony Wiest

(57) ABSTRACT

The present invention is directed an adjustable foot rest system for a kayak comprising a bulkhead member adapted for cinchable non-slip support of the feet and on the fly user positioning. A mounting sleeve in the bow wall and/or runners are provided with the bulkhead resting inside the sleeve and/or runners by friction alone. Flexible straps equipped with strap adjusters are connected to the bulkhead, through guide anchors and secured to anchors affixed to the inside hull of the kayak near the seat. A bungee cord is threaded through an anchor disposed near the end of the bow and connected on each side to the bulkhead cross member, whereby the bulkhead position as selected by the user remains in place until the user selects a new position.

7 Claims, 11 Drawing Sheets

ADJUSTABLE AND CINCHABLE FLOATING BULKHEAD SYSTEM FOR A KAYAK

BACKGROUND OF THE INVENTION

Field of the Invention

The present invention relates to improvements in the foot rest system of a kayak.

Kayaks employ either of two basic foot rest systems. The first such system is comprised of a pair of individual foot pegs, attached mechanically to either side of the bow, to separately support each foot. The second system is comprised of a unitary bulkhead, similarly disposed in the bow, on which the user supports both feet.

For whitewater kayaks, the use of foot pegs has fallen out of favor as they provide limited surface area for contact with the user's feet and as a result, foot slippage can cause loss of control of the kayak or injury to the legs and ankles. Bulkheads, on the other hand, provide a larger surface area on which to rest the feet. While this system is common to whitewater kayaks, other types of kayaks may also employ bulkhead systems.

As known in the art, the overwhelming majority of bulkhead systems share a common design feature: the bulkhead is mechanically attached to rigid rails, a rigid cross member, or both which are in turn affixed to the hull of the kayak. These rigid components are normally made of aluminum. For systems with rails, the hull attachment points occur along the sides at or near the cockpit. Cross member only systems (without rails) attach to the hull where the bulkhead cross member engages the bow at the sides of the kayak. Mechanical fasteners such as screws and bolts are used at the attachment points. Such bulkhead systems, while providing direct and solid mechanical contact with the kayak, are by nature stationary. Adjustment to the bulkhead position can only be achieved by removing the mechanical fasteners and repositioning the rails or cross member to a new location and then refastening. Typically, rigid rails will be fitted with a row of multiple screw holes to allow for adjustment. Cross member only systems generally require drilling new attachment points along the sides of the kayak. By necessity, adjustments to traditional stationary bulkheads must be accomplished by the user from outside the kayak and often require the use of hand tools.

One alternate system, also known in the art, allows the bulkhead to be adjusted from a seated position inside the kayak. This system is comprised of a unitary bulkhead that moves along a slot in a foam bow wall support and is secured using a rope that runs internal within the wall. The rope can be pulled to tighten the bulkhead and is locked in place by a plastic cleat fastener attached to the front of the wall. The entire bulkhead system is contained and supported by the bow wall. There are no attachment points that independently or directly secure the bulkhead to the hull of the kayak. The bow wall (with mounted bulkhead assembly) fits into the bow cavity and is secured in place using a face plate on the front of the wall. The faceplate is secured to the deck of the kayak and to a horizontal hull floor support which runs under the seat and connects bow wall to stern wall.

While solving the problem of inside the boat adjustability, this system (unlike a traditional stationary bulkhead) has been known to slip when impacting an immovable object. Under these circumstances, the rope often breaks free of the cleat and the bulkhead slides free along the slot toward the bow. The paddler looses foot pressure on the bulkhead and possibly control over the kayak. Furthermore, this type system is also prone to loosening once the bow wall becomes wet and as the paddler applies pressure to the bulkhead with his feet. The wall tends to compress in these instances and the bulkhead can slip forward. Finally, the bulkhead itself is supported entirely by the structure of the bow wall. Compromises to the bow wall foam or assembly can result in total failure of the bulkhead system.

In view of the above, a need has existed in the art to provide a bulkhead system whose position is fully adjustable by the user while seated in the kayak and yet which has the structural integrity and non-slip fixed positioning associated with a traditional stationary bulkhead.

As additional impetus, the current art of kayak manufacture utilizes two distinct classes of raw materials and methods to create boats with differing properties. The first such class involves creating kayaks from molding pelletized plastics such as polyethylene. The second class comprises composite kayaks made from resins such as epoxy and vinyl ester and woven fabrics such as carbon fiber and aramid. Prior art bulkhead system design has focused primarily on applications for plastic kayaks while ignoring the unique properties and design advantages that are available with composite kayaks.

As a result, there exists an additional need in the art for a bulkhead system design that will work for composite kayaks as well as those made from plastics.

BRIEF SUMMARY OF THE INVENTION

It is therefore an object of the present invention to provide a bulkhead system adapted to allow the paddler to adjust the position of the bulkhead while seated inside the kayak while in use on the water and to provide a non-slip fixed foot support for the user under extreme conditions.

To achieve these primary objects, the present invention replaces the rigid metal rails and fasteners of prior art bulkhead designs with flexible straps equipped with strap adjusting hardware and coupled to looped anchor points that are affixed to each side on the inside of the kayak. Left and right straps (with respect to the seated user) are connected to their respective ends of the bulkhead, coupled to looped anchor points and threaded back through common strap adjusters such that the user can pull concurrently on the ends of each strap and cinch the bulkhead toward the seat tightening himself into the kayak.

To achieve the cinching function, it is necessary that the present invention also provide for a floating bulkhead. The floating bulkhead is capable of moving forward and backward inside the bow along the longitudinal axis of the kayak. The present invention provides for floating bulkheads with one friction point as well as multiple friction points. The one friction point floating bulkhead requires a horizontal slot to be cut into the vertical bow support wall along which the bulkhead can move. Dual friction point floating bulkheads that do not require a bow support wall are also provided. These utilize channelized runners disposed inside the bow along each side. The ends of the bulkhead cross member are disposed within the channels to allow the bulkhead to move freely forwards or backwards. Furthermore, bulkheads which utilize a combination of bow support wall slots and channelized runners are also provided.

Finally, to hold the bulkhead steady in its selected position, the present invention also provides a force that is in the opposite direction of that provided by the cinch straps. To accomplish this, the present invention provides a rebounding stretch cord that couples the floating bulkhead to a loop anchor disposed in the end of the bow of the kayak. The stretch cord provides a constant force pulling the bulkhead away from the seat. When the user desires to relax the tightness and position of the bulkhead the strap adjusters can be loosened and the opposite force provided by the stretch cord will move the bulkhead away from the user's feet.

A further object of the invention is to provide an adjustable bulkhead system for use in all types of kayaks of any material of construction. The present invention utilizes different loop anchor mechanisms to provide for various materials of construction.

These and other objects of the present invention will become apparent from the following drawings and detailed specification taken together with the representative examples.

DETAILED DESCRIPTION OF THE INVENTION

Figure 1:
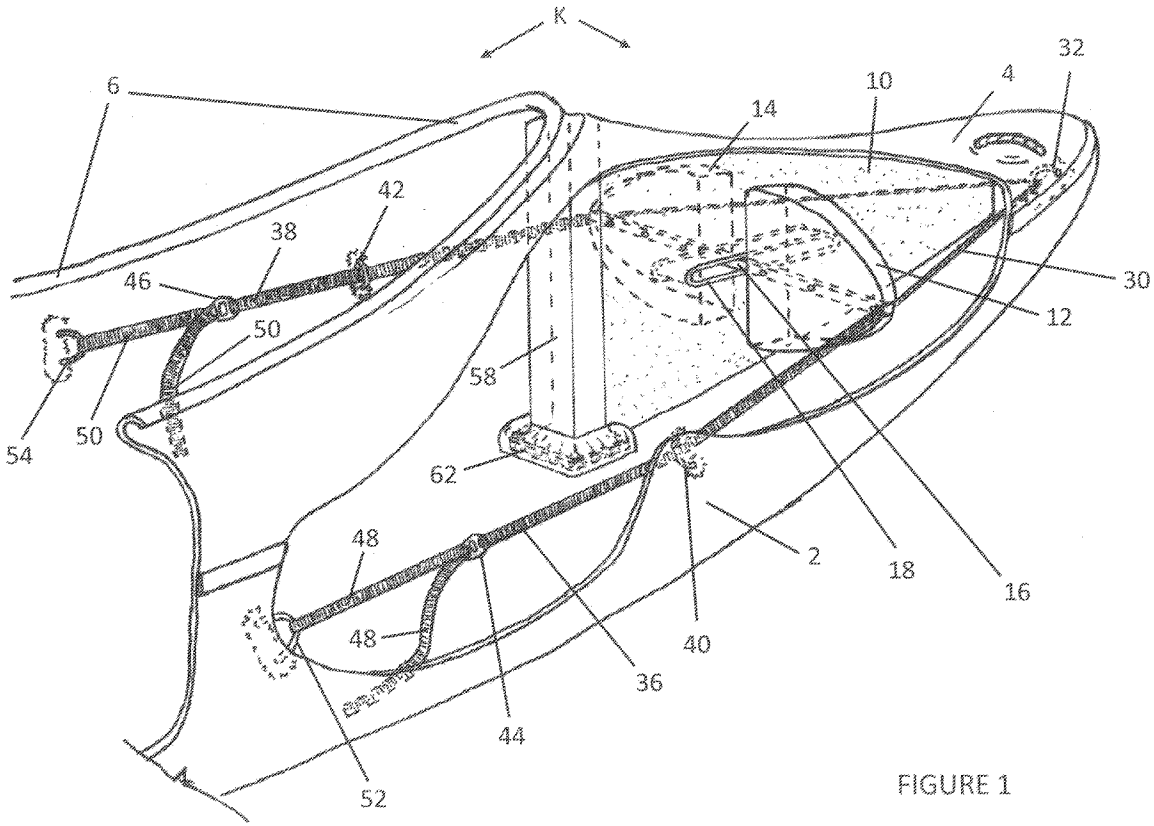
FIG. 1 is a perspective view of a kayak having a portion broken away to illustrate the adjustable bulkhead system according to the present invention.
Figure 2:
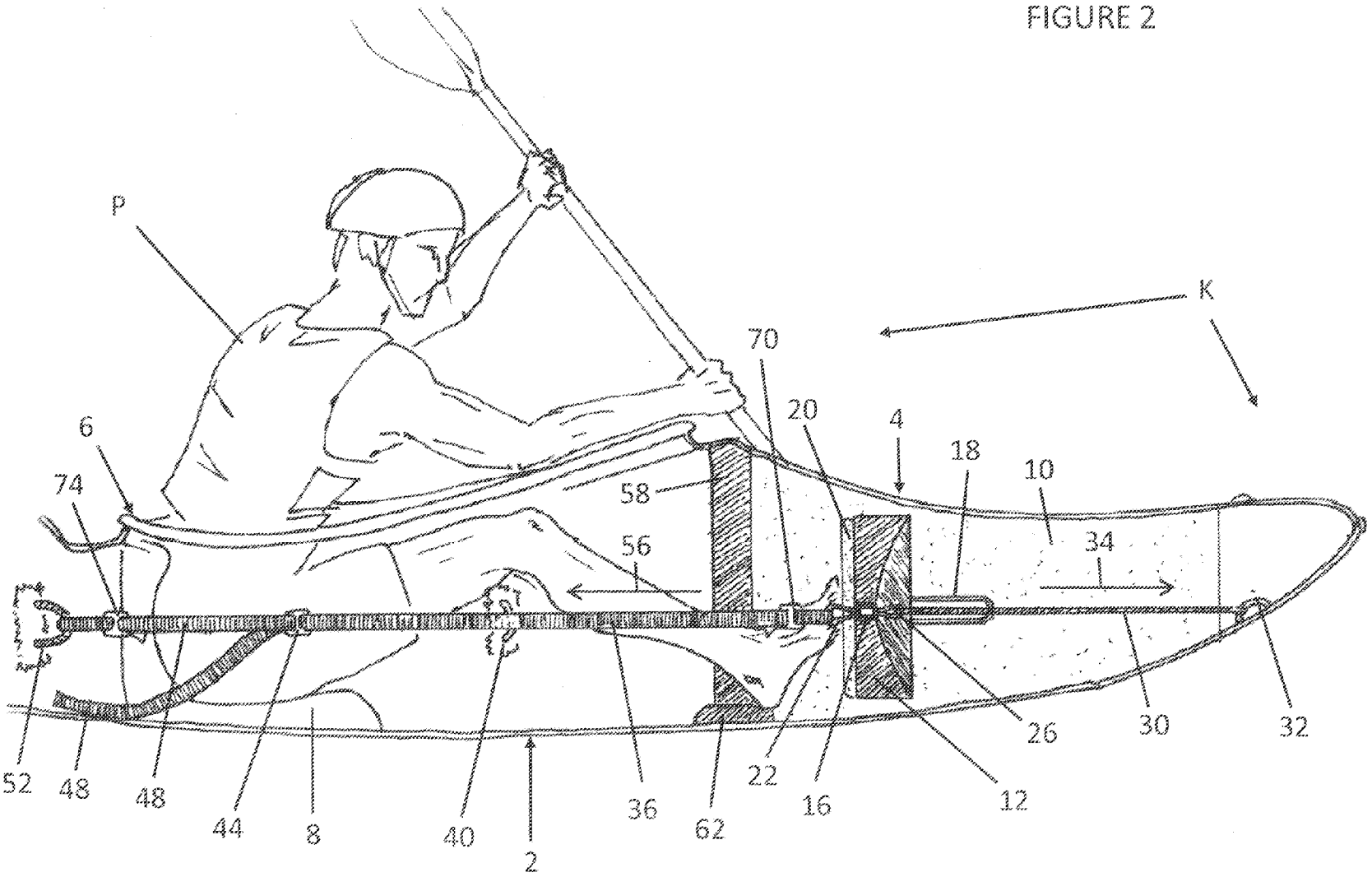
FIG. 2 is a side elevation view of the kayak shown in FIG. 1 with the bulkhead and other system components shown in cross-section.

Turning to FIG. 1 and FIG. 2, the bow of a kayak, K, is shown and generally includes a hull, 2, and deck, 4. A cockpit, 6, is formed on the deck, 4 and shown in FIG. 2 to seat a paddler, P. While in the seated position, the paddler, P, is resting on a seat, 8, with legs forward and knees slightly bent.

A foot support member, shown in FIGS. 1 and 2 as a unitary bulkhead is provided and positioned, as known in the art, in the forward portion or bow of kayak, K. The bulkhead shown is comprised of two separate pedals, 12 and 14, rendered unitary by cross member, 16. Cross member, 16, passes through rigid sleeve, 18, forming a cutout through wall, 10. Rigid sleeve 18 lies within and flush to wall 10 to allow smooth movement of cross member 16 and thus the bulkhead. Pedals, 12 and 14, are affixed to cross member, 16, using mechanical fasteners. Foam pads, 20, are glued to pedals, 12 and 14, to provide grip and cushioning to the feet of paddler, P. The bulkhead forming the foot support according to the present invention floats within sleeve, 18, and is not secured to the hull, 2, of the kayak, K, but is adapted to lie perpendicular to and move adjacently along the length of the interior wall, 10, of the kayak.

Figure 3:
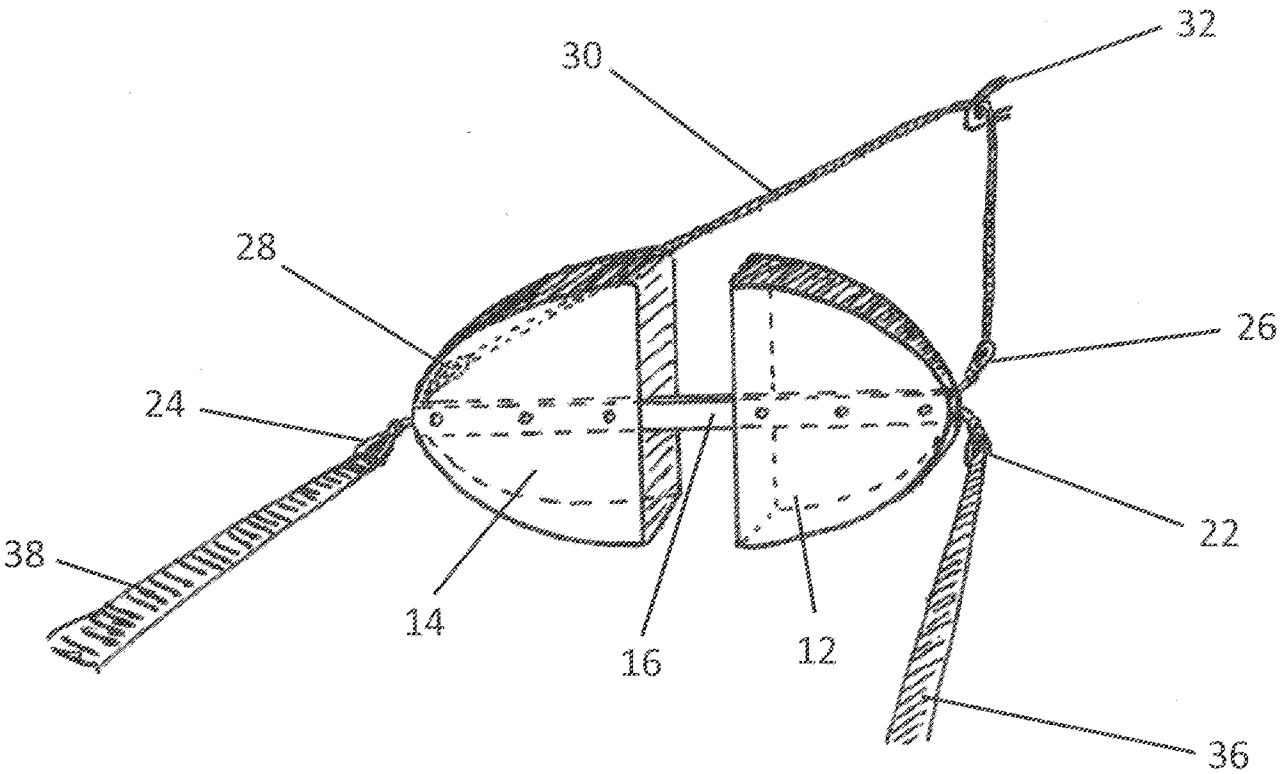
FIG. 3 is a perspective detail view of the bulkhead and corresponding attachment locations with the bow wall and cross member sleeve removed for illustration.

Turning also now to FIG. 3, it can be seen that secured to each end of cross member 16, are two loops, 22 and 26, on one end and 24 and 28 on the other. Loop 22 and 24 are comprised and formed from separate segments of flexible rope and secured to mounting screws for pedals 12 and 14 respectively. Loops 26 and 28 are similarly secured and formed from separate rope segments.

A bungee cord, flexible rubber strap or other stretchable band, 30, is securely fastened to loop 26, threaded through anchor 32 around the end of wall 10, and fastened to loop 28. Anchor 32 is positioned such that bungee cord 30 lies parallel to cutout sleeve 18 and perpendicular to the faces of pedals 12 and 14 on which the paddler, P, rests his feet. The length of bungee cord 30 is fashioned such that it exerts continual force on the bulkhead pulling it toward the end of the bow in direction 34 regardless of the position of cross member 16 with respect to sleeve 18.

Separate flexible straps, 36 and 38, are affixed respectively at one end to loops 22 and 24 and pass along the sides of the hull, 2, through guide anchors 40 and 42 respectively. The remaining ends of flexible straps 36 and 38 are affixed to separate strap adjusters (as known in the art of strap hardware), 44 and 46 respectively.

Additional and separate flexible straps, 48 and 50, are affixed at one end to anchors 52 and 54 respectively. The remaining ends of flexible straps 48 and 50 are threaded through strap adjusters 44 and 46 respectively.

Anchors 52 and 54 and guide anchors 40 and 42 are positioned such that, when under tension, flexible straps, 36 and 38 and flexible straps 48 and 50 lie parallel to cutout sleeve 18 and perpendicular to the faces of pedals 12 and 14 on which the paddler, P, rests his feet. Furthermore, when under tension, straps 36, 38, 48, 50 and bungee cord 30 all lie, generally speaking, within the same horizontal plane which is, in turn, perpendicular to the faces of pedals 12 and 14 on which the paddler, P, rests his feet.

When paddler, P, pulls simultaneously on the ends of straps 48 and 50, the bulkhead will move in the direction of arrow 56, counter to the force exerted by bungee 30 which will stretch and provide opposite force to keep the bulkhead in the selected location. Through this means, paddler, P, can "synch" himself into the kayak, K, adjusting the bulkhead location to fit the length of his legs while remaining seated in the boat while in use on the water. Alternately, by simply flipping the tabs on strap adjusters 44 and 46, paddler P, can immediately loosen straps 48 and 50 to reduce the tension of the bulkhead for added comfort. Upon loosening the straps, the bulkhead, through the force exerted by bungee 30, moves back in the direction of arrow 34. This adjustment can also be made without exiting the kayak, K.

Because the bulkhead, according to the present invention, truly floats within sleeve 18 and is not affixed to the hull by rigid rails and fasteners, but instead utilizes flexible straps as configured above, it is useful to firmly secure the position of wall, 10, in the bow of the kayak, K.

Figures 4A, 4B, 4C:
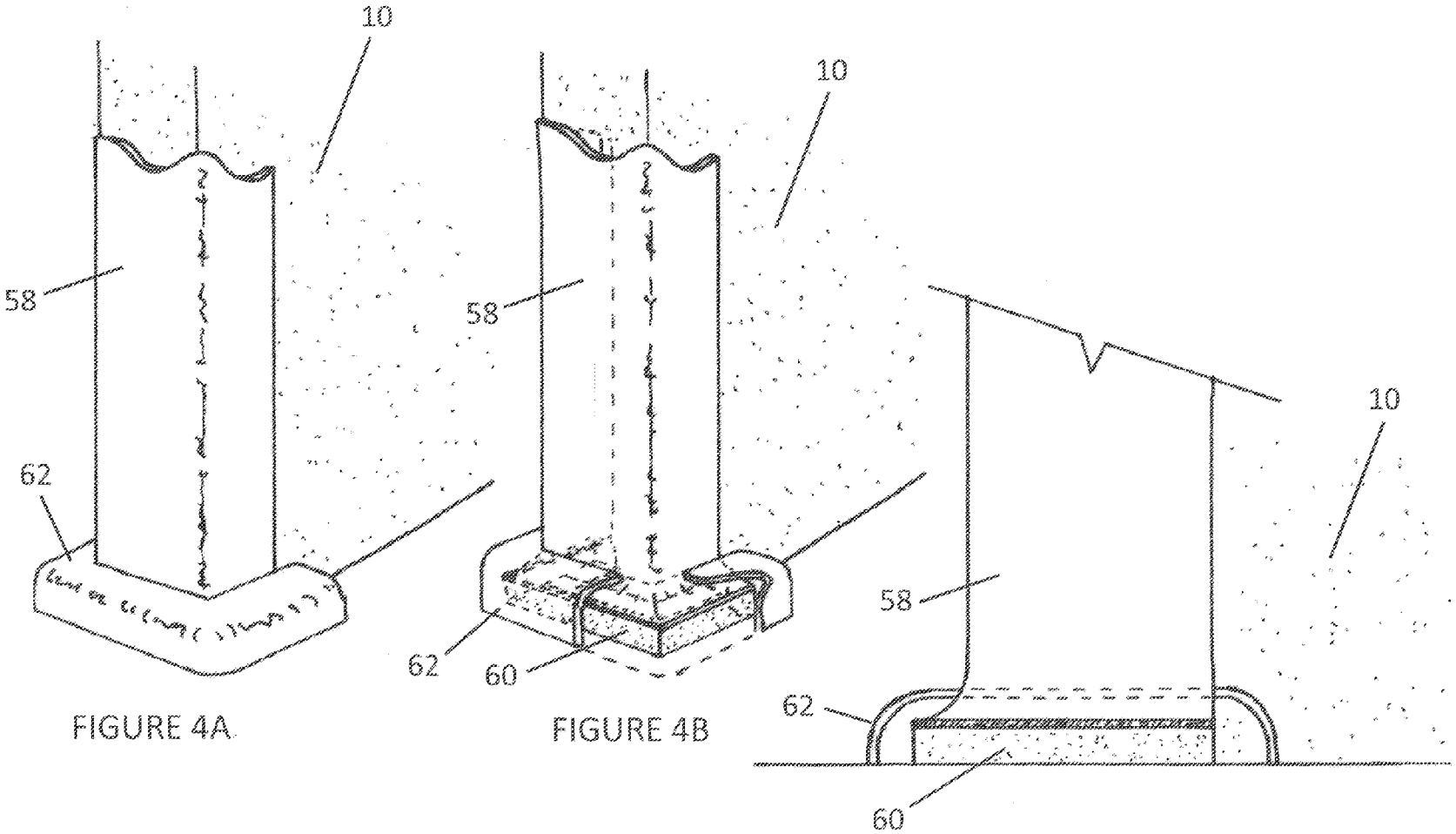
FIG. 4A is a perspective view of the wall support system according to the present invention.
FIG. 4B is a perspective view of the wall support system with cutaway to illustrate the provision for hull deformation according to the present invention.
FIG. 4C is a side elevation view of the wall support system to illustrate the provision for hull deformation according to the present invention.

To do so, wall support, 58, is comprised of an elongated "U" or channel shaped sleeve that is fashioned to entirely wrap the front face and a portion of both side faces of wall 10. The top of wall support 58 is firmly and permanently affixed to the underside of deck, 4, utilizing resin and woven cloth as is known in the art. As shown in FIGS. 4B, and 4C, the bottommost portion of wall support 58 turns out perpendicularly into a short flange under which is glued flexible foam, 60. Flange cover, 62, sits atop the flange and is permanently affixed to the bottom of the inside hull, 2, of the kayak, K, using resin and woven cloth as is known in the art. The flange cover is secured only at the bottom so that when the hull, 2, is deformed under typical use, the foam is allowed to compress and the flange cover floats up wall support 58.

The resulting configuration serves to secure the wall, 10, into place and provides rigid vertical support and shock absorbing energy transfer from the hull, 2, into the deck, 4, upon impact of the hull, 2, near the cockpit, 6.

Additional details of the preferred embodiments are described below:

Bow wall 10 is typically made from closed minicell foam, as known in the art, though other wall materials rigid, flexible or otherwise are within the scope of the present invention.

Pedals 12 and 14 are preferably constructed from composite materials such as carbon fiber and aramid though other materials of construction such as plastic or metal are within the scope of the present invention.

Figure 5:
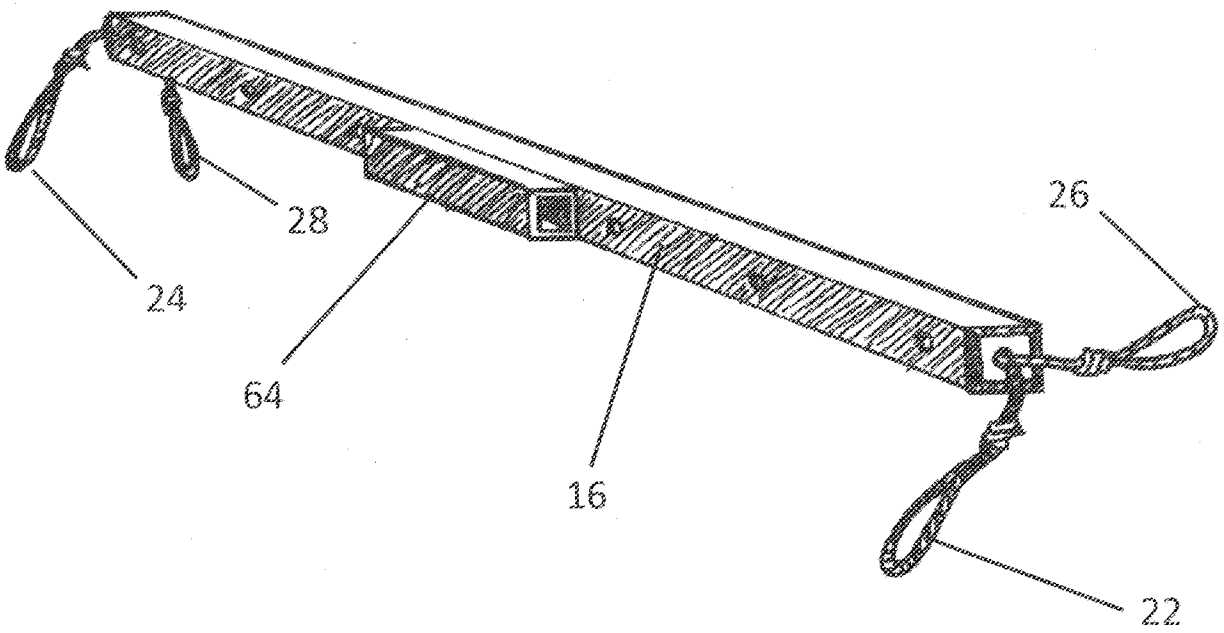
FIG. 5 is a perspective detail view of the cross member, cross member appendage, and attachment loops according to the present invention.
Figure 6:
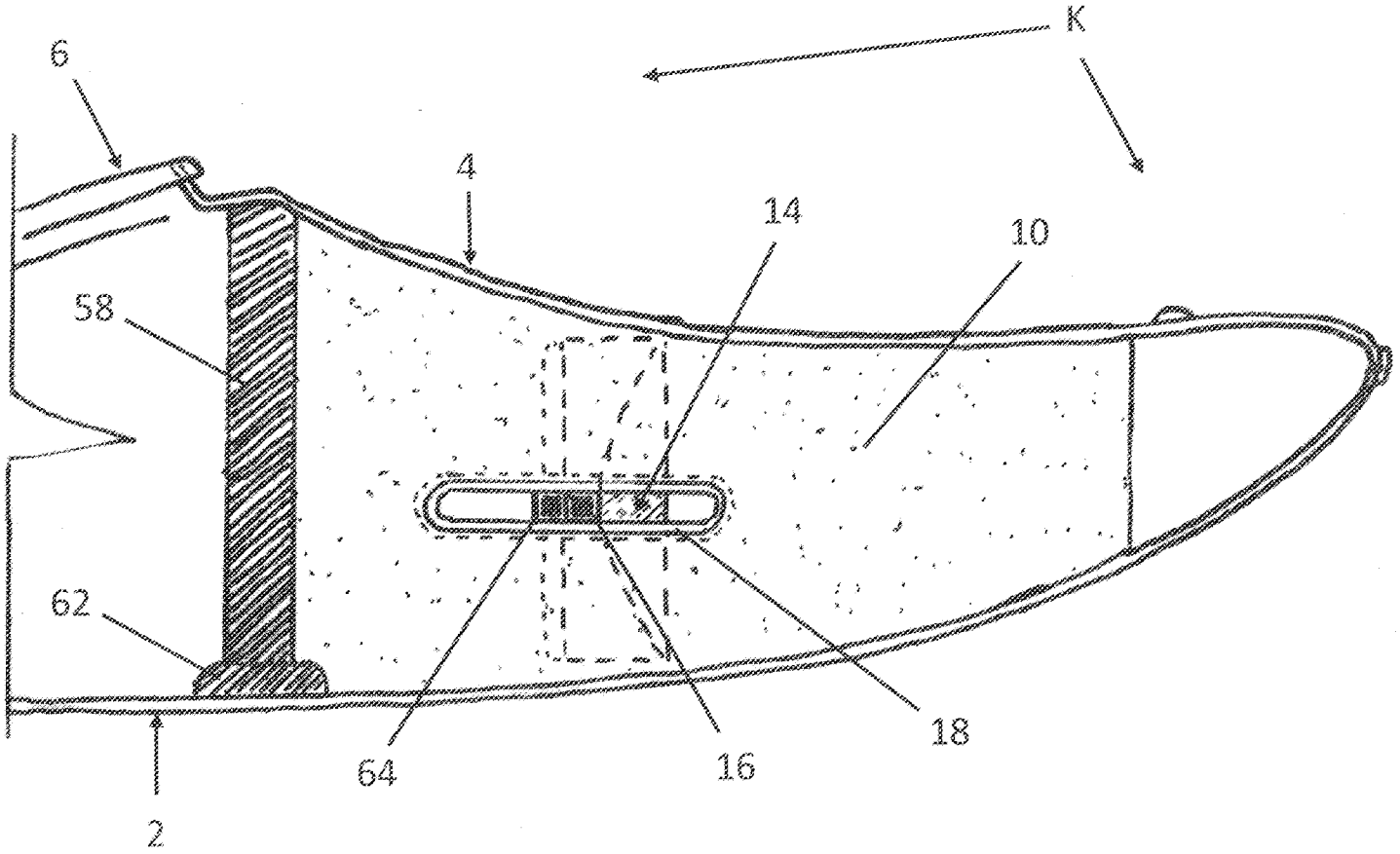
FIG. 6 is a side elevation view of the bow with the right bulkhead pedal, bungee and flexible straps removed for illustration.

Turning to FIG. 5 and FIG. 6, cross member, 16, is a square tube made from aluminum, carbon fiber, or other light weight rigid material. Attached and centered to the front of cross member, 16, by mechanical fasteners is appendage, 64. Appendage 64 is a small length of tube, fashioned from the same material as cross member 16, and cut shorter than the width of bow wall 10. Appendage 64 is centered, aligned flush to, and affixed along cross member 16 in such a way as to rest entirely inside sleeve 18 when the bulkhead is assembled and in use.

Sleeve 18 is preferably made from carbon fiber and aramid but other rigid materials such as plastic or metal are within the scope of the present invention. The longitudinal length of sleeve 18 is fashioned such that a wide range of users with various heights and leg lengths can be accommodated. Appendage 64 and cross member 16 combine to form a rigid rectangle that rests wholly within sleeve 18 preventing cross member 16 from spinning within sleeve 18 when extreme force is applied to the top or bottom of pedals 12 and 14. Alternately, and within the scope of the present invention, cross member 16 can be fashioned from a single rectangular tube or rectangular metal plate provided the inside height of sleeve 18 and the height of cross member 16 are generally the same and the width of cross member 16 is greater than its height.

Flexible straps 36, 38, 48, and 50 are preferably made from flat polyester webbing though other materials such as flat nylon webbing, tubular webbings, ropes, cords or other flexible segments are within the scope of the present invention.

Anchors 32, 52, and 54 are fashioned from U shaped segments of rope a portion of which are unraveled at each end and affixed to the hull using resin and a reinforcing cloth as known in the art.

Guide Anchors 40 and 42 are fashioned from vertical segments of rope a portion of which are unraveled at each end and affixed to the hull using resin and a reinforcing cloth as also known in the art.

Wall support 58 and flange cover 62 are preferably made of carbon fiber, though other materials of construction such as fiberglass or aramid are also within the scope of the present invention.

Additional short segments of "U" shaped wall support pieces, not shown but similar to wall support 58 though narrower and without the flange, may be affixed to the deck, 4 and hull, 2, via resin and reinforcing cloth, as known in the art, to further secure the wall, 10 to the kayak, K.

The details of the preferred embodiments discussed above were done so relative to kayaks constructed from composite materials. However, the scope of the present invention also pertains to kayaks made from pelletized plastics, wood, or other materials and is not limited as such.

The present invention encompasses alternate embodiments listed below but not limited to the following:

Loop attachment points on cross member 16 shown in FIG. 3 can be replaced with extra drill holes, metal eyelets, hooks, links of chain, metal rings, swivel hooks or various other hardware onto which an attachment can be rendered and are considered within the scope of the present invention.

Figure 7:
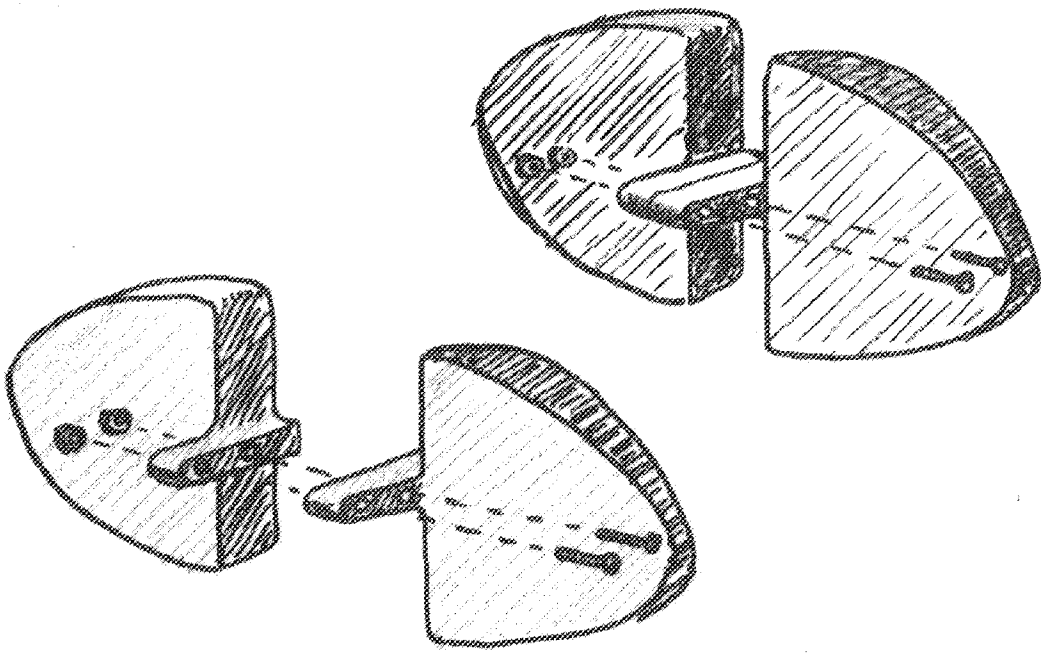
FIG. 7 is a perspective view of a solid bulkhead with a solid middle cross member according to the present invention.
Figure 8:
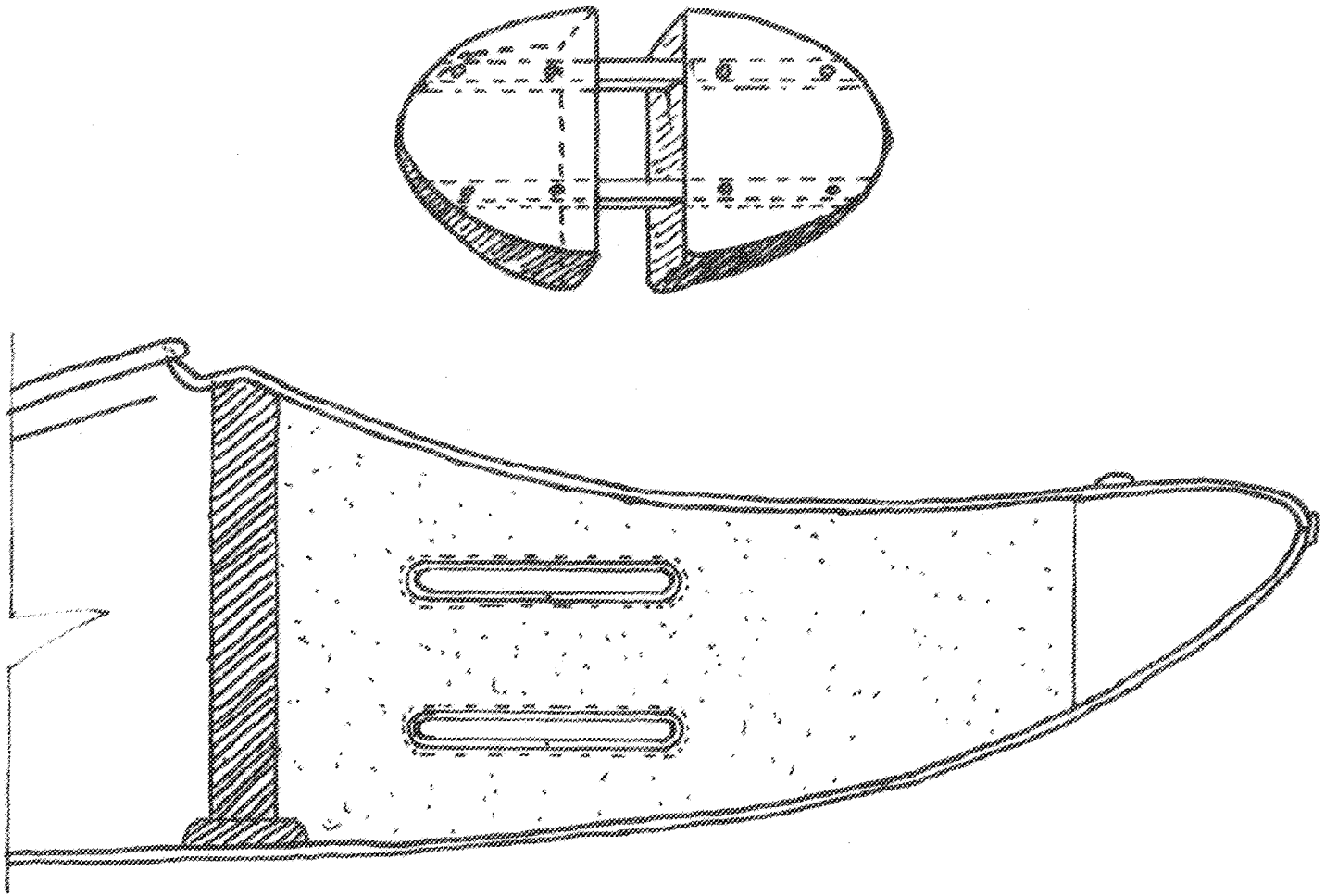
FIG. 8 illustrates an alternate bulkhead design according to the present invention.

Other foot support members are also within the scope of the present invention. While a bulkhead as shown in the drawings and otherwise known in the art is preferred, other rigid and unitary members fashioned to support the feet of the user are within the scope of the present invention. One example is shown in FIG. 7 where a two piece bulkhead with attachment points located at the rectangular shaped middle cross member is illustrated. The cross member is tapered at the ends to fit the ends of sleeve 18. Another example can be shown in FIG. 8 where a double cross member, double sleeve bulkhead system is rendered. Other examples include various shapes and sizes of pedals 12 and 14, cross member 16, and sleeve 18 and variations in their assembly relative to one another to create a unitary bulkhead.

Also within the scope of the present invention, sleeve 18 can be replaced with a simple slot cut into the bow wall. This slot can be lined on top and bottom with plastic or metal reinforcement to reduce friction or left unreinforced provided the bulkhead cross member can slide freely.

Furthermore, the use of multiple bungee cords, rubber straps or other flexible cords to replace or be used in conjunction with the single bungee cord as described in the preferred embodiment is also considered within the scope of the present invention. To achieve this, additional anchor points to the bulkhead, deck, 4, or hull, 2, may be added. These additional anchoring points are considered within the scope of the present invention.

Also within the scope of the invention is a bulkhead system which floats at the ends of the cross member in addition to floating at the middle of the cross member as discussed in the preferred embodiment. To illustrate how this is accomplished, the bow wall was removed from the drawing in FIG. 9. Two elongated "U" shaped channel runners, 66 and 68, are affixed along each side of the hull with screws or other mechanical fasteners. Runners 66 and 68 are aligned parallel to one another, parallel to the bow wall and generally within the same horizontal planes as sleeve, 18 (shown previously in FIG. 1 et al.). Cross member 16 is fitted through sleeve 18 with the ends resting in runners 66 and 68. The cross member can be adjusted forward and backwards as before, according to the present invention.

Figure 10:
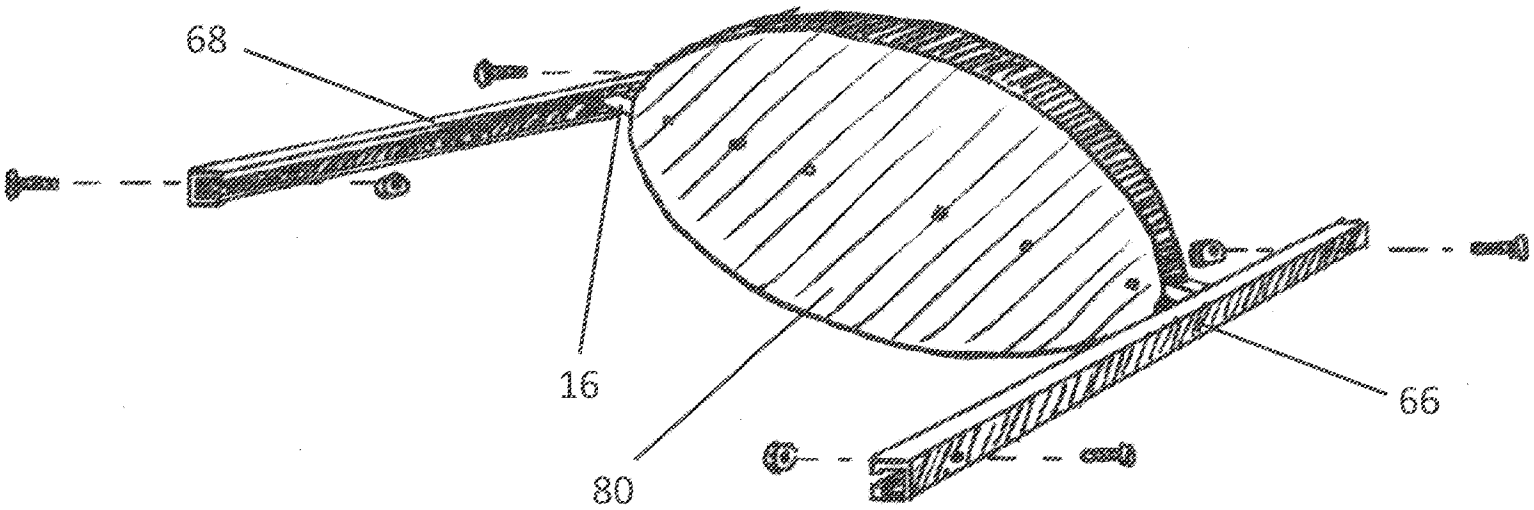
FIG. 10 is a perspective view of a single piece floating bulkhead for use in kayaks without a bow wall according to the present invention. The bungee, flexible straps and anchor, though present, have been removed from the drawing for illustration.

Furthermore, the scope of the present invention can be extended to kayaks without bow walls. For this application, runners 66 and 68, can be used alone as the tracking mechanism with the bulkhead floating at each end of cross member, 16. In this scenario, a single piece bulkhead, 80, as shown in FIG. 10, can be utilized as the foot rest.

Also within the scope of the present invention are varieties in how the straps are secured, configured and aligned. For example, in the preferred embodiment, strap sliders (as known in the art of strap hardware), 70, 72, 74, and 76, are used to secure straps 36 and 38 to the bulkhead and straps 48 and 50 to anchors 52 and 54 respectively. Other methods of securing the straps include the use of tied knots or sewn loops. In another example, a single strap with or without a sewn strap adjuster can be configured to replace the two-strap-per-side system as described in the preferred embodiment. A final example includes the use of multiple guide anchors to pilot the straps closer to the hull walls or elsewhere.

Figure 9:
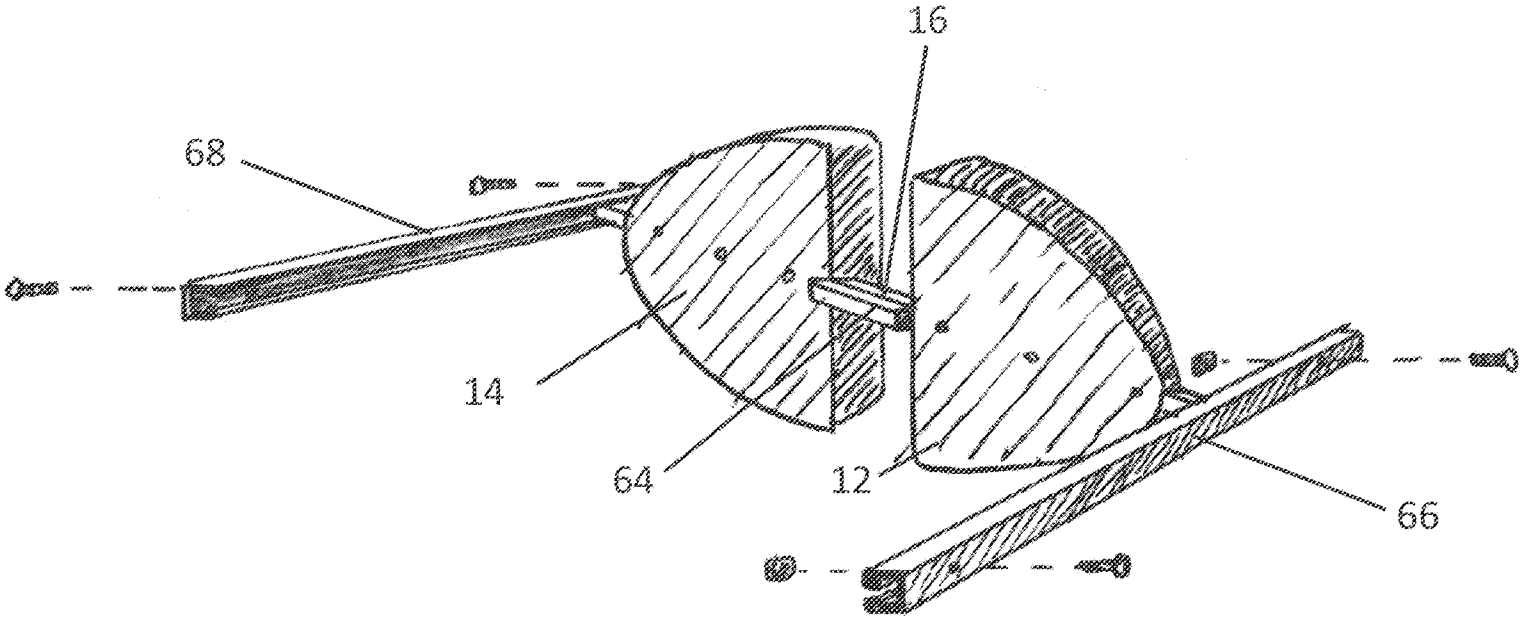
FIG. 9 is a perspective view of the use of channelized side runners in conjunction with a bow wall according to the present invention. The bow wall, cross member sleeve, bungee, flexible straps and anchor, though present, have been removed from the drawing for illustration.

Anchors 32, 52, and 54 and guide anchors 40 and 46 were discussed in the detailed embodiment to be made of rope and secured using resin and woven cloth reinforcement as known in the art. Within the scope of the present invention are varieties on the materials used for their construction and how said anchors are attached to the hull of the kayak. For example, sturdy metal "D" rings, "0" rings, and other loops and guides affixed to a mounting plate can be secured to the hull using mechanical fasteners. As a second example, in plastic kayaks the bow grab loop and seat, as known in the art, are typically attached to the hull using mechanical fasteners. These points of attachment can be doubly purposed to mount sturdy metal anchors 32, 52, and 54 to the underside of the deck. In another example, metal runners, 66 and 68 (as shown in FIGS. 9 and 10) can include a guide (not shown) at the opening closest to the cockpit through which straps 36 and 38 are threaded. As a final example, sturdy anchors can be molded in situ during the manufacture of plastic kayaks.

Figure 11:
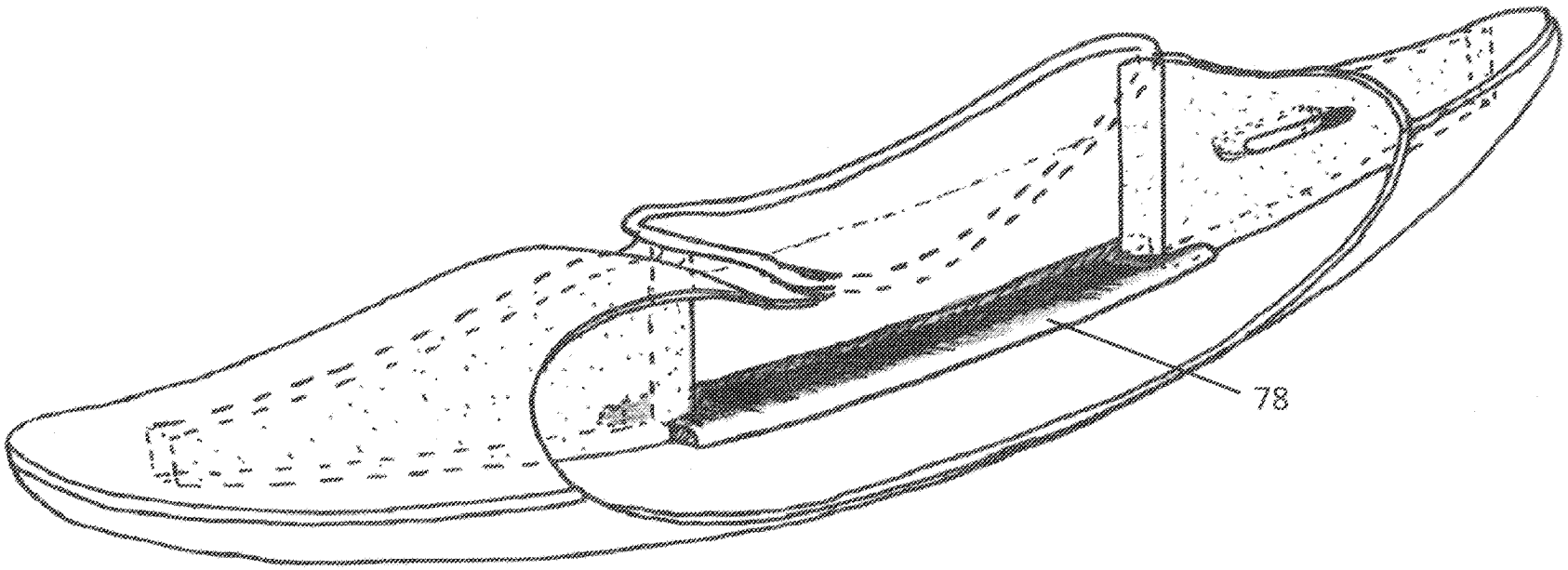
FIG. 11 is a perspective view of a kayak with hull and wall support piece as known in the art.

As known in the art, plastic kayaks generally utilize a hull support piece, 78 (as illustrated in FIG. 11), in conjunction with slots molded into the deck (not shown) and/or plastic hardware (not shown) affixed to the deck with mechanical fasteners to stabilize and support both the bow and stern walls of a kayak. For this reason, wall support 58 and subsequent flange cover 62 (as shown in FIGS. 1, 2, 4A, et al.) recommended for composite kayaks are not necessary. The scope of the present invention pertains to both composite and plastic kayaks regardless of the means of securing the bow wall or whether the bow wall is secured whatsoever.

Finally, while this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

What is claimed is:

1. A foot rest system for a kayak comprising:

a) a vertical bow support wall fitted with at least one horizontal slot;

b) a foot support member having left and right sides relative to the seated user, said foot support member having left and right ends relative to the seated user, said foot support member comprising at least one cross member, at least one left foot support pedal, and at least one right foot support pedal;

c) said at least one cross member of said foot support member is disposed within said at least one horizontal slot of said vertical bow support wall whereby said foot support member can move both in the direction of a bow end of said kayak and in the direction of a stern end of said kayak within said horizontal slot and whereby said foot support member supports both feet of the user;

d) at least one rebounding stretch band attached to said foot support member and coupled to at least one bow loop anchor, said at least one bow loop anchor is attached inside the bow of said kayak whereby said at least one rebounding stretch band applies constant force to said foot support member in the direction of the bow end of said kayak;

e) at least one flexible left support strap disposed on the left side of said kayak relative to the seated user, said at least one flexible left support strap equipped with strap adjusting mechanism;

f) at least one flexible right support strap disposed on the right side of said kayak relative to the seated user, said at least one flexible right support strap equipped with strap adjusting mechanism;

g) at least one left side loop anchor attached on the inside of the left side of said kayak relative to the seated user;

h) at least one right side loop anchor attached on the inside of the right side of said kayak relative to the seated user;

i) said at least one flexible left support strap attached to said left end of said foot support member, said at least one flexible left support strap coupled to said at least one left side loop anchor and threaded through strap adjusting mechanism on said at least one flexible left support strap and;

j) said at least one flexible right support strap attached to said right end of said foot support member, said at least one flexible right support strap coupled to said at least one right side loop anchor and threaded through strap adjusting mechanism on said at least one flexible right support strap whereby the user can pull concurrently on said at least one flexible left support strap and said at least one flexible right support strap to move and tighten said foot support member in the direction of the stern end of said kayak.

2. A foot rest system for a kayak as in claim 1 wherein:

a) said horizontal slot of said vertical bow support wall is reinforced with at least one rigid sleeve.

3. A foot rest system for a kayak as in claim 1 wherein:

a) at least one support channel is attached to the inside of the bow of said kayak, one end of said at least one cross member is further disposed within said at least one support channel whereby said foot support member can move both in the direction of the bow end of said kayak and in the direction of the stern end of said kayak within said support channel and within said horizontal slot.

4. A foot rest system for a kayak as in claim 3 wherein:

a) said horizontal slot of said vertical bow support wall is reinforced with at least one rigid sleeve.

5. A foot rest system for a kayak comprising:

a) a foot support member having left and right ends relative to the seated user, said foot support member comprising at least one cross member, said cross member having left and right ends and said foot support member adapted to support both feet of the user;

b) at least one left support channel attached to an inside of a left side of a bow of said kayak relative to the seated user;

c) at least one right support channel attached to a inside of a right side of the bow of said kayak relative to the seated user;

d) said left end of said at least one cross member is disposed within said at least one left support channel, said right end of said at least one cross member is disposed within said at least one right support channel whereby said foot support member can move both in the direction of the bow end of said kayak and in the direction of the stern end of said kayak within said left support channel and within said right support channel;

e) at least one rebounding stretch band attached to said foot support member and coupled to at least one bow loop anchor, said at least one bow loop anchor is attached inside the bow of said kayak whereby said at least one rebounding stretch band applies constant force to said foot support member in the direction of the bow end of said kayak;

f) at least one flexible left support strap disposed on the left side of said kayak relative to the seated user, said at least one flexible left support strap equipped with a strap adjusting mechanism;

g) at least one flexible right support strap disposed on the right side of said kayak relative to the seated user, said at least one flexible right support strap equipped with a strap adjusting mechanism;

h) at least one left side loop anchor attached on the inside of the left side of said kayak relative to the seated user;

i) at least one right side loop anchor attached on the inside of the right side of said kayak relative to the seated user;

j) said at least one flexible left support strap attached to said left end of said foot support member, said at least one flexible left support strap coupled to said at least one left side loop anchor and threaded through said strap adjusting mechanism on said at least one flexible left support strap and;

k) said at least one flexible right support strap attached to said right end of said foot support member, said at least one flexible right support strap coupled to said at least one right side loop anchor and threaded through said strap adjusting mechanism on said at least one flexible right support strap whereby the user can pull concurrently on said at least one flexible left support strap and said at least one flexible right support strap to move and tighten said foot support member in the direction of the stern end of said kayak.

6. A foot rest system for a kayak as in claim 5 wherein:

a) said foot support member further comprising at least one left foot support pedal and at least one right foot support pedal, said foot support member having left and right sides relative to the seated user;

b) said at least one cross member of said foot support member is further disposed within at least one horizontal slot of a vertical bow support wall whereby said foot support member can move both in the direction of the bow end of said kayak and in the direction of the stern end of said kayak within said horizontal slot, within said left support channel, and within said right support channel and whereby said foot support member supports both feet of the user.

7. A foot rest system for a kayak as in claim 6 wherein:

a) said horizontal slot of said vertical bow support wall is reinforced with at least one rigid sleeve.

* * * * *